US008042484B2

(12) United States Patent
Pervan et al.

(10) Patent No.: US 8,042,484 B2
(45) Date of Patent: Oct. 25, 2011

(54) APPLIANCE AND METHOD FOR SURFACE TREATMENT OF A BOARD SHAPED MATERIAL AND FLOORBOARD

(75) Inventors: Darko Pervan, Viken (SE); Jan Peterson, Lerberget (SE); Niclas Håkansson, Helsingborg (SE)

(73) Assignee: Valinge Innovation AB, Viken (SE)

( * ) Notice: Subject to any disclaimer, the term of this patent is extended or adjusted under 35 U.S.C. 154(b) by 409 days.

(21) Appl. No.: 11/163,085

(22) Filed: Oct. 4, 2005

(65) Prior Publication Data

US 2006/0073320 A1 Apr. 6, 2006

Related U.S. Application Data

(60) Provisional application No. 60/615,963, filed on Oct. 6, 2004.

(30) Foreign Application Priority Data

Oct. 5, 2004 (SE) ..... 0402419

(51) Int. Cl.
*B05C 11/06* (2006.01)

(52) U.S. Cl. ..... 118/63; 118/256; 118/259; 118/261

(58) Field of Classification Search ..... 118/256, 118/261, 62, 63, 665, 677, 688, 708, 712, 118/259, 602, 304, DIG. 16; 427/348, 350; 156/578

See application file for complete search history.

(56) References Cited

U.S. PATENT DOCUMENTS

| | | | | |
|---|---|---|---|---|
| 213,740 | A | 4/1879 | Conner | |
| 714,987 | A | 12/1902 | Wolfe | |
| 753,791 | A | 3/1904 | Fulghum | |
| 1,124,228 | A | 1/1915 | Houston | |
| 1,194,636 | A | 8/1916 | Joy | |
| 1,371,856 | A | 3/1921 | Cade | |
| 1,407,679 | A | 2/1922 | Ruthrauff | |
| 1,454,250 | A | 5/1923 | Parsons | |
| 1,468,288 | A | 9/1923 | Een | |
| 1,477,813 | A | 12/1923 | Daniels et al. | |
| 1,510,924 | A | 10/1924 | Daniels et al. | |
| 1,540,128 | A | 6/1925 | Houston | |
| 1,568,605 | A * | 1/1926 | Hough | 427/210 |
| 1,575,821 | A | 3/1926 | Daniels | |
| 1,602,256 | A | 10/1926 | Sellin | |
| 1,602,267 | A | 10/1926 | Karwisch | |
| 1,615,096 | A | 1/1927 | Meyers | |

(Continued)

FOREIGN PATENT DOCUMENTS

AT 218725 B 12/1961

(Continued)

OTHER PUBLICATIONS

Webster's Dictionary, Random House: New York (1987), p. 862.

(Continued)

*Primary Examiner* — Laura Edwards
(74) *Attorney, Agent, or Firm* — Buchanan Ingersoll & Rooney P.C.

(57) ABSTRACT

A device for coating surface portions of a board material with a liquid material. The device includes a wheel which transfers the coating material and compressed air which positions the coating material. A method for surface coating and a floorboard with a finished surface portion.

29 Claims, 3 Drawing Sheets

U.S. PATENT DOCUMENTS

| | | | | | |
|---|---|---|---|---|---|
| 1,622,103 | A | | 3/1927 | Fulton | |
| 1,622,104 | A | | 3/1927 | Fulton | |
| 1,637,634 | A | | 8/1927 | Carter | |
| 1,644,710 | A | | 10/1927 | Crooks | |
| 1,660,480 | A | | 2/1928 | Daniels | |
| 1,714,738 | A | | 5/1929 | Smith | |
| 1,718,702 | A | | 6/1929 | Pfiester | |
| 1,734,826 | A | | 11/1929 | Pick | |
| 1,764,331 | A | | 6/1930 | Moratz | |
| 1,778,069 | A | | 10/1930 | Fetz | |
| 1,787,027 | A | | 12/1930 | Wasleff | |
| 1,790,178 | A | | 1/1931 | Sutherland, Jr. | |
| 1,823,039 | A | | 9/1931 | Gruner | |
| 1,859,667 | A | | 5/1932 | Gruner | |
| 1,809,393 | A | | 6/1932 | Rockwell | |
| 1,898,364 | A | | 2/1933 | Gynn | |
| 1,906,411 | A | | 5/1933 | Potvin | |
| 1,929,871 | A | | 10/1933 | Jones | |
| 1,940,377 | A | | 12/1933 | Storm | |
| 1,953,306 | A | | 4/1934 | Moratz | |
| 1,986,739 | A | | 1/1935 | Mitte | |
| 1,988,201 | A | | 1/1935 | Hall | |
| 2,026,511 | A | | 12/1935 | Storm | |
| 2,044,216 | A | | 6/1936 | Klages | |
| 2,082,186 | A | * | 6/1937 | Staude | 118/250 |
| 2,266,464 | A | | 12/1941 | Kraft | |
| 2,269,926 | A | | 1/1942 | Crooks | |
| 2,276,071 | A | | 3/1942 | Scull | |
| 2,324,628 | A | | 7/1943 | Kähr | |
| 2,398,632 | A | | 4/1946 | Frost et al. | |
| 2,430,200 | A | | 11/1947 | Wilson | |
| 2,495,862 | A | | 1/1950 | Osborn | |
| 2,497,837 | A | | 2/1950 | Nelson | |
| 2,679,231 | A | | 5/1954 | Pomper et al. | |
| 2,740,167 | A | | 4/1956 | Rowley | |
| 2,780,253 | A | | 2/1957 | Joa | |
| 2,791,983 | A | * | 5/1957 | Driskell | 118/219 |
| 2,811,133 | A | | 10/1957 | Heino | |
| 2,851,740 | A | | 9/1958 | Baker | |
| 2,865,058 | A | | 12/1958 | Andersson et al. | |
| 2,872,712 | A | | 2/1959 | Brown et al. | |
| 2,894,292 | A | | 7/1959 | Gramelspacher | |
| 2,947,040 | A | | 8/1960 | Schultz | |
| 3,045,294 | A | | 7/1962 | Livezey, Jr. | |
| 3,050,758 | A | * | 8/1962 | Wilkins | 15/100 |
| 3,100,556 | A | | 8/1963 | De Ridder | |
| 3,120,083 | A | | 2/1964 | Dahlberg et al. | |
| 3,125,138 | A | | 3/1964 | Bolenbach | |
| 3,182,769 | A | | 5/1965 | De Ridder | |
| 3,200,553 | A | | 8/1965 | Frashour et al. | |
| 3,203,149 | A | | 8/1965 | Soddy | |
| 3,247,638 | A | | 4/1966 | Gay | |
| 3,267,630 | A | | 8/1966 | Omholt | |
| 3,282,010 | A | | 11/1966 | King, Jr. | |
| 3,301,147 | A | | 1/1967 | Clayton et al. | |
| 3,310,919 | A | | 3/1967 | Bue et al. | |
| 3,377,931 | A | | 5/1967 | Hilton | |
| 3,339,525 | A | * | 9/1967 | Roberts | 118/63 |
| 3,341,351 | A | | 9/1967 | Brewer | |
| 3,347,048 | A | | 10/1967 | Brown et al. | |
| 3,354,867 | A | | 11/1967 | Pomper et al. | |
| 3,387,422 | A | | 6/1968 | Wanzer | |
| 3,440,790 | A | | 4/1969 | Nerem | |
| 3,460,304 | A | | 8/1969 | Braeuninger et al. | |
| 3,481,810 | A | | 12/1969 | Waite | |
| 3,508,523 | A | | 4/1970 | De Meerleer | |
| 3,526,420 | A | | 9/1970 | Brancalcone | |
| 3,538,665 | A | | 11/1970 | Gohner | |
| 3,548,559 | A | | 12/1970 | Levine | |
| 3,553,919 | A | | 1/1971 | Omholt | |
| 3,555,762 | A | | 1/1971 | Costanzo, Jr. | |
| 3,579,941 | A | | 5/1971 | Tibbals | |
| 3,627,608 | A | | 12/1971 | Steiner et al. | |
| 3,694,983 | A | | 10/1972 | Couquet | |
| 3,714,747 | A | | 2/1973 | Curran | |
| 3,731,445 | A | | 5/1973 | Hoffmann et al. | |
| 3,759,007 | A | | 9/1973 | Thiele | |
| 3,768,846 | A | | 10/1973 | Hensley et al. | |
| 3,786,608 | A | | 1/1974 | Boettcher | |
| 3,825,381 | A | | 7/1974 | Dunning et al. | |
| 3,842,562 | A | | 10/1974 | Daigle | |
| 3,857,749 | A | | 12/1974 | Yoshida | |
| 3,859,000 | A | | 1/1975 | Webster | |
| 3,902,293 | A | | 9/1975 | Witt et al. | |
| 3,908,053 | A | | 9/1975 | Hettich | |
| 3,932,258 | A | | 1/1976 | Brinkman et al. | |
| 3,936,551 | A | | 2/1976 | Elmendorf et al. | |
| 3,988,187 | A | | 10/1976 | Witt et al. | |
| 3,998,181 | A | * | 12/1976 | Bellen et al. | 118/665 |
| 4,037,377 | A | | 7/1977 | Howell et al. | |
| 4,054,477 | A | | 10/1977 | Curran | |
| 4,076,880 | A | | 2/1978 | Geschwender | |
| 4,084,996 | A | | 4/1978 | Wheeler | |
| 4,090,338 | A | | 5/1978 | Bourgade | |
| 4,099,358 | A | | 7/1978 | Compaan | |
| 4,100,710 | A | | 7/1978 | Kowallik | |
| 4,102,975 | A | | 7/1978 | Doerer | |
| 4,147,448 | A | | 4/1979 | Jeffery | |
| 4,169,688 | A | | 10/1979 | Toshio | |
| RE30,233 | E | | 3/1980 | Lane et al. | |
| 4,227,430 | A | | 10/1980 | Jansson et al. | |
| 4,242,390 | A | | 12/1980 | Nemeth | |
| 4,290,248 | A | | 9/1981 | Kemerer et al. | |
| 4,299,070 | A | | 11/1981 | Oltmanns et al. | |
| 4,304,083 | A | | 12/1981 | Anderson | |
| 4,426,820 | A | | 1/1984 | Terbrack et al. | |
| 4,471,012 | A | | 9/1984 | Maxwell | |
| 4,489,115 | A | | 12/1984 | Layman et al. | |
| 4,501,102 | A | | 2/1985 | Knowles | |
| 4,561,233 | A | | 12/1985 | Harter et al. | |
| 4,567,706 | A | | 2/1986 | Wendt | |
| 4,612,074 | A | | 9/1986 | Smith et al. | |
| 4,612,745 | A | | 9/1986 | Hovde | |
| 4,641,469 | A | | 2/1987 | Wood | |
| 4,643,237 | A | | 2/1987 | Rosa | |
| 4,645,481 | A | * | 2/1987 | Klapp | 493/150 |
| 4,646,494 | A | | 3/1987 | Saarinen et al. | |
| 4,648,165 | A | | 3/1987 | Whitehorne | |
| 4,653,242 | A | | 3/1987 | Ezard | |
| 4,703,597 | A | | 11/1987 | Eggemar | |
| 4,715,162 | A | | 12/1987 | Brightwell | |
| 4,716,700 | A | | 1/1988 | Hagemeyer | |
| 4,738,071 | A | | 4/1988 | Ezard | |
| 4,751,957 | A | * | 6/1988 | Vaught | 164/463 |
| 4,769,963 | A | | 9/1988 | Meyerson | |
| 4,819,932 | A | | 4/1989 | Trotter, Jr. | |
| 4,822,440 | A | | 4/1989 | Hsu et al. | |
| 4,831,806 | A | | 5/1989 | Niese et al. | |
| 4,845,907 | A | | 7/1989 | Meek | |
| 4,850,838 | A | | 7/1989 | Wagner et al. | |
| 4,905,442 | A | | 3/1990 | Daniels | |
| 5,029,425 | A | | 7/1991 | Bogataj | |
| 5,096,408 | A | | 3/1992 | Bielfeldt | |
| 5,111,579 | A | | 5/1992 | Andersen | |
| 5,113,632 | A | | 5/1992 | Hanson | |
| 5,117,603 | A | | 6/1992 | Weintraub | |
| 5,148,850 | A | | 9/1992 | Urbanick | |
| 5,165,816 | A | | 11/1992 | Parasin | |
| 5,179,812 | A | | 1/1993 | Hill | |
| 5,190,088 | A | | 3/1993 | Thomassen et al. | |
| 5,213,819 | A | | 5/1993 | Bielfeldt | |
| 5,216,861 | A | | 6/1993 | Meyerson | |
| 5,253,464 | A | | 10/1993 | Nilsen | |
| 5,271,564 | A | | 12/1993 | Smith | |
| 5,286,545 | A | | 2/1994 | Simmons, Jr. | |
| 5,295,341 | A | | 3/1994 | Kajiwara | |
| 5,349,796 | A | | 9/1994 | Meyerson | |
| 5,390,457 | A | | 2/1995 | Sjölander | |
| 5,433,806 | A | | 7/1995 | Pasquali et al. | |
| 5,474,831 | A | | 12/1995 | Nystrom | |
| 5,497,589 | A | | 3/1996 | Porter | |
| 5,502,939 | A | | 4/1996 | Zadok et al. | |
| 5,540,025 | A | | 7/1996 | Takehara et al. | |
| 5,560,569 | A | | 10/1996 | Schmidt | |
| 5,567,497 | A | | 10/1996 | Zegler et al. | |
| 5,570,554 | A | | 11/1996 | Searer | |
| 5,582,906 | A | | 12/1996 | Romesberg et al. | |

5,587,218 A 12/1996 Betz
5,597,024 A 1/1997 Bolyard et al.
5,613,894 A 3/1997 Delle Vedove
5,618,602 A 4/1997 Nelson
5,630,304 A 5/1997 Austin
5,641,553 A 6/1997 Tingley
5,653,099 A 8/1997 MacKenzie
5,671,575 A 9/1997 Wu
5,695,875 A 12/1997 Larsson et al.
5,706,621 A 1/1998 Pervan
5,755,068 A 5/1998 Ormiston
5,768,850 A 6/1998 Chen
5,797,237 A 8/1998 Finkell, Jr.
5,823,240 A 10/1998 Bolyard et al.
5,827,592 A 10/1998 Van Gulik et al.
5,860,267 A 1/1999 Pervan
5,899,038 A 5/1999 Stroppiana
5,900,099 A 5/1999 Sweet et al.
5,925,211 A 7/1999 Rakauskas
5,935,668 A 8/1999 Smith
5,943,239 A 8/1999 Shamblin et al.
5,968,625 A 10/1999 Hudson
5,987,839 A 11/1999 Hamar et al.
6,006,486 A 12/1999 Moriau et al.
6,023,907 A 2/2000 Pervan
6,029,416 A 2/2000 Andersson
6,094,882 A 8/2000 Pervan
6,101,778 A 8/2000 Martensson
6,115,926 A 9/2000 Robell
6,119,423 A 9/2000 Costantino
6,126,883 A 10/2000 Troetscher et al.
6,134,854 A 10/2000 Stanchfield
6,146,252 A 11/2000 Martensson
6,148,884 A 11/2000 Bolyard et al.
6,173,548 B1 1/2001 Hamar et al.
6,180,211 B1 1/2001 Held
6,182,410 B1 2/2001 Pervan
6,203,653 B1 3/2001 Seidner
6,205,639 B1 3/2001 Pervan
6,209,278 B1 4/2001 Tychsen
6,216,403 B1 4/2001 Belbeoc'h
6,216,409 B1 4/2001 Roy et al.
6,247,285 B1 6/2001 Mobeus
6,314,701 B1 11/2001 Meyerson
6,324,803 B1 12/2001 Pervan
6,332,733 B1 12/2001 Hamberger et al.
6,339,908 B1 1/2002 Chuang
6,345,481 B1 2/2002 Nelson
6,363,677 B1 4/2002 Chen et al.
6,374,880 B2 4/2002 Macpherson
6,385,936 B1 5/2002 Schneider
6,397,547 B1 6/2002 Martensson
6,401,415 B1 6/2002 Garcia
6,421,970 B1 7/2002 Martensson et al.
6,438,919 B1 8/2002 Knauseder
6,446,405 B1 9/2002 Pervan
6,490,836 B1 12/2002 Moriau et al.
6,497,079 B1 12/2002 Pletzer et al.
6,505,452 B1 1/2003 Hannig et al.
6,510,665 B2 1/2003 Pervan
6,516,579 B1 2/2003 Pervan
6,526,719 B2 3/2003 Pletzer et al.
6,532,709 B2 3/2003 Pervan
6,536,178 B1 3/2003 Palsson et al.
6,584,747 B2 7/2003 Kettler et al.
6,601,359 B2 8/2003 Olofsson
6,606,834 B2 8/2003 Martensson et al.
6,617,009 B1 9/2003 Chen et al.
6,647,689 B2 11/2003 Pletzer et al.
6,647,690 B1 11/2003 Martensson
6,670,019 B2 12/2003 Andersson
6,672,030 B2 1/2004 Schulte
6,679,011 B2 1/2004 Beck
6,684,592 B2 2/2004 Martin
6,715,253 B2 4/2004 Pervan
6,722,809 B2 4/2004 Hamberger et al.
6,763,643 B1 7/2004 Martensson
6,766,622 B1 7/2004 Thiers
6,769,218 B2 8/2004 Pervan
6,769,219 B2 8/2004 Schwitte et al.
6,786,019 B2 9/2004 Thiers et al.
6,854,235 B2 2/2005 Martensson
6,862,857 B2 3/2005 Tychsen
6,874,292 B2 4/2005 Moriau et al.
6,933,043 B1 8/2005 Son et al.
7,003,924 B2 2/2006 Kettler et al.
7,022,189 B2 4/2006 Delle Vedove et al.
7,040,068 B2 5/2006 Moriau et al.
7,047,697 B1 5/2006 Heath
7,101,438 B2 * 9/2006 Suzuki et al. ..... 118/249
7,137,229 B2 11/2006 Pervan
7,584,583 B2 9/2009 Bergelin et al.
2001/0029720 A1 10/2001 Pervan
2002/0014047 A1 2/2002 Thiers
2002/0020127 A1 2/2002 Thiers et al.
2002/0023702 A1 2/2002 Kettler
2002/0031646 A1 3/2002 Chen et al.
2002/0046528 A1 4/2002 Pervan et al.
2002/0069611 A1 6/2002 Leopolder
2002/0100231 A1 8/2002 Miller et al.
2002/0178673 A1 12/2002 Pervan
2002/0178674 A1 12/2002 Pervan
2002/0178682 A1 12/2002 Pervan
2002/0189183 A1 12/2002 Ricciardelli
2003/0009972 A1 1/2003 Pervan et al.
2003/0024199 A1 2/2003 Pervan et al.
2003/0033777 A1 2/2003 Thiers et al.
2003/0033784 A1 2/2003 Pervan
2003/0041545 A1 3/2003 Stanchfield
2003/0084636 A1 5/2003 Pervan
2003/0101674 A1 6/2003 Pervan et al.
2003/0115812 A1 6/2003 Pervan
2003/0115821 A1 6/2003 Pervan
2003/0159385 A1 8/2003 Thiers
2003/0196405 A1 10/2003 Pervan
2003/0221387 A1 12/2003 Shah
2003/0233809 A1 12/2003 Pervan
2004/0016196 A1 1/2004 Pervan
2004/0031227 A1 2/2004 Knauseder
2004/0035077 A1 2/2004 Martensson
2004/0035078 A1 2/2004 Pervan
2004/0035079 A1 2/2004 Evjen
2004/0108625 A1 6/2004 Moder et al.
2004/0139678 A1 7/2004 Pervan
2004/0177584 A1 9/2004 Pervan
2004/0182036 A1 9/2004 Sjoberg et al.
2004/0206036 A1 10/2004 Pervan
2004/0241374 A1 12/2004 Thiers et al.
2004/0255541 A1 12/2004 Thiers et al.
2005/0034404 A1 2/2005 Pervan
2005/0034405 A1 2/2005 Pervan
2005/0055943 A1 3/2005 Pervan
2005/0102937 A1 5/2005 Pervan
2005/0108970 A1 5/2005 Liu
2005/0138881 A1 6/2005 Pervan
2005/0160694 A1 7/2005 Pervan
2005/0161468 A1 7/2005 Wagner
2005/0166502 A1 8/2005 Pervan et al.
2005/0166514 A1 8/2005 Pervan
2005/0166516 A1 8/2005 Pervan
2005/0193677 A1 9/2005 Vogel
2005/0208255 A1 9/2005 Pervan
2005/0210810 A1 9/2005 Pervan
2005/0235593 A1 10/2005 Hecht
2006/0048474 A1 3/2006 Pervan
2006/0099386 A1 5/2006 Smith
2006/0110490 A1 5/2006 Nien
2006/0117696 A1 6/2006 Pervan
2006/0144004 A1 7/2006 Nollet et al.
2006/0179773 A1 8/2006 Pervan
2006/0196139 A1 9/2006 Pervan
2006/0260253 A1 11/2006 Brice
2006/0283127 A1 12/2006 Pervan
2007/0119110 A1 5/2007 Pervan
2007/0175143 A1 8/2007 Pervan et al.
2007/0175144 A1 8/2007 Hakansson
2007/0175148 A1 8/2007 Bergelin
2007/0175156 A1 8/2007 Pervan et al.

| | | | |
|---|---|---|---|
| 2008/0000179 | A1 | 1/2008 | Pervan |
| 2008/0000183 | A1 | 1/2008 | Bergelin |
| 2008/0000190 | A1 | 1/2008 | Hakansson |
| 2008/0000417 | A1 | 1/2008 | Pervan |
| 2008/0005989 | A1 | 1/2008 | Pervan et al. |
| 2008/0034701 | A1 | 2/2008 | Pervan |
| 2008/0066425 | A1 | 3/2008 | Jacobsson |
| 2008/0120938 | A1 | 5/2008 | Jacobsson |
| 2008/0263975 | A1 | 10/2008 | Mead |

FOREIGN PATENT DOCUMENTS

| | | | |
|---|---|---|---|
| AU | 713628 | | 1/1998 |
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2226286 | | 12/1997 |
| CA | 2252791 | | 5/1999 |
| CA | 2289309 | | 7/2000 |
| CA | 2 363 184 | A1 | 7/2001 |
| CH | 200949 | | 1/1939 |
| CH | 211877 | | 1/1941 |
| CH | 690242 | A5 | 6/2000 |
| CN | 1376230 | A | 10/2002 |
| DE | 1 212 275 | | 3/1966 |
| DE | 7102476 | | 1/1971 |
| DE | 1 534 278 | | 11/1971 |
| DE | 2 159 042 | | 11/1971 |
| DE | 2 205 232 | | 8/1973 |
| DE | 7402354 | | 1/1974 |
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41781 | A1 | 6/1982 |
| DE | 32 14 207 | A1 | 11/1982 |
| DE | 32 46 376 | C2 | 6/1984 |
| DE | 33 43 601 | A1 | 6/1985 |
| DE | 35 38 538 | A1 | 10/1985 |
| DE | 86 04 004 | | 6/1986 |
| DE | 35 12 204 | A1 | 10/1986 |
| DE | 35 44 845 | A1 | 6/1987 |
| DE | 36 31 390 | A1 | 12/1987 |
| DE | 40 02 547 | A1 | 8/1991 |
| DE | 41 30 115 | A1 | 9/1991 |
| DE | 41 34 452 | A1 | 4/1993 |
| DE | 42 15 273 | A1 | 11/1993 |
| DE | 42 42 530 | A1 | 6/1994 |
| DE | 43 13 037 | C1 | 8/1994 |
| DE | 93 17 191 | U1 | 3/1995 |
| DE | 296 10 462 | U1 | 10/1996 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 299 22 649 | U1 | 4/2000 |
| DE | 199 07 939 | C1 | 5/2000 |
| DE | 200 01 225 | U1 | 8/2000 |
| DE | 200 02 744 | U1 | 9/2000 |
| DE | 199 25 248 | A1 | 12/2000 |
| DE | 200 13 380 | U1 | 12/2000 |
| DE | 200 17 461 | U1 | 3/2001 |
| DE | 200 18 284 | U1 | 3/2001 |
| DE | 100 01 248 | | 7/2001 |
| DE | 100 32 204 | C1 | 7/2001 |
| DE | 100 08 166 | A1 | 9/2001 |
| DE | 100 34 407 | C1 | 10/2001 |
| DE | 100 34 407 | C2 | 10/2001 |
| DE | 100 44 016 | A1 | 3/2002 |
| DE | 100 57 901 | A1 | 6/2002 |
| DE | 202 05 774 | U1 | 8/2002 |
| DE | 202 06 460 | U1 | 8/2002 |
| DE | 203 07 580 | U1 | 7/2003 |
| DE | 10232508 | C1 | 12/2003 |
| DE | 203 14 850 | U1 | 1/2004 |
| DE | 203 17 527 | U1 | 1/2004 |
| DE | 20 2004 001 038 | U1 | 5/2004 |
| DE | 20 2005 006 300 | U1 | 8/2005 |
| DE | 10 2004 054 368 | A1 | 5/2006 |
| EP | 0 248 127 | A1 | 12/1987 |
| EP | 0 487 925 | A1 | 6/1992 |
| EP | 0 623 724 | A1 | 11/1994 |
| EP | 0 652 340 | A1 | 5/1995 |
| EP | 0 665 347 | | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | B1 | 11/1998 |
| EP | 0 958 441 | | 11/1998 |
| EP | 0 661 135 | B1 | 12/1998 |
| EP | 0 903 451 | A2 | 3/1999 |
| EP | 0 969 163 | A2 | 1/2000 |
| EP | 0 969 163 | A3 | 1/2000 |
| EP | 0 969 164 | A2 | 1/2000 |
| EP | 0 969 164 | A3 | 1/2000 |
| EP | 0 974 713 | A1 | 1/2000 |
| EP | 0 976 889 | | 2/2000 |
| EP | 1 048 423 | A2 | 11/2000 |
| EP | 1 120 515 | A1 | 8/2001 |
| EP | 1 146 182 | A2 | 10/2001 |
| EP | 1 165 906 | | 1/2002 |
| EP | 1 223 265 | | 7/2002 |
| EP | 1 228 812 | A1 | 8/2002 |
| EP | 1 251 219 | A1 | 10/2002 |
| EP | 1 262 609 | | 12/2002 |
| EP | 1 317 983 | A2 | 6/2003 |
| EP | 1 338 344 | A2 | 8/2003 |
| EP | 1 357 239 | A2 | 10/2003 |
| EP | 1 357 239 | A3 | 10/2003 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| FR | 2 810 060 | A1 | 12/2001 |
| FR | 2 846 023 | A1 | 4/2004 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1171337 | | 11/1969 |
| GB | 1237744 | | 6/1971 |
| GB | 1275511 | | 5/1972 |
| GB | 1394621 | | 5/1975 |
| GB | 1430423 | | 3/1976 |
| GB | 2117813 | A | 10/1983 |
| GB | 2126106 | A | 3/1984 |
| GB | 2243381 | A | 10/1991 |
| GB | 2256023 | A | 11/1992 |
| JP | 48-071434 | A | 9/1973 |
| JP | 49-031028 | B | 8/1974 |
| JP | 50-151232 | A | 12/1975 |
| JP | 54-65528 | | 5/1979 |
| JP | 55-099774 | U | 7/1980 |
| JP | 57-119056 | | 7/1982 |
| JP | 57-162668 | A | 10/1982 |
| JP | 57-185110 | | 11/1982 |
| JP | 59-186336 | | 11/1984 |
| JP | 3-169967 | | 7/1991 |
| JP | 4-106264 | | 4/1992 |
| JP | 4-191001 | | 7/1992 |

| | | | |
|---|---|---|---|
| JP | 5-148984 | | 6/1993 |
| JP | 6-56310 | | 5/1994 |
| JP | 6-146553 | | 5/1994 |
| JP | 06280376 | A | 10/1994 |
| JP | 7-076923 | | 3/1995 |
| JP | 7-180333 | | 7/1995 |
| JP | 6-320510 | | 11/1995 |
| JP | 7-300979 | | 11/1995 |
| JP | 7-310426 | | 11/1995 |
| JP | 8-033861 | A | 2/1996 |
| JP | 8-086080 | A | 4/1996 |
| JP | 8-109734 | | 4/1996 |
| JP | 9-38906 | | 2/1997 |
| JP | 9-88315 | | 3/1997 |
| JP | 2000 179137 | | 6/2000 |
| JP | P2000 226932 | | 8/2000 |
| JP | 2001 173213 | | 6/2001 |
| JP | 2001 179710 | | 7/2001 |
| JP | 2001 254503 | | 9/2001 |
| JP | 2001 260107 | | 9/2001 |
| JP | P2001 329681 | | 11/2001 |
| JP | 2002-276139 | A | 9/2002 |
| JP | 2002-371635 | A | 12/2002 |
| JP | 2003-126759 | A | 5/2003 |
| JP | 2003200405 | A | 7/2003 |
| KR | 2007000322 | A | 1/2007 |
| NL | 7601773 | | 8/1976 |
| NO | 157871 | | 7/1984 |
| NO | 305614 | | 5/1995 |
| PL | 24931 | U | 11/1974 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SE | 525 661 | C2 | 3/2005 |
| SU | 363795 | | 11/1973 |
| SU | 1680359 | A1 | 9/1991 |
| WO | WO 84/02155 | | 6/1984 |
| WO | WO 87/03839 | A1 | 7/1987 |
| WO | WO 92/17657 | | 10/1992 |
| WO | WO 93/13280 | | 7/1993 |
| WO | WO 94/01628 | | 1/1994 |
| WO | WO 94/26999 | | 11/1994 |
| WO | WO 96/27719 | | 9/1996 |
| WO | WO 96/27721 | | 9/1996 |
| WO | WO 96/30177 | A1 | 10/1996 |
| WO | 97/19232 | | 5/1997 |
| WO | WO 97/47834 | | 12/1997 |
| WO | WO 98/22677 | A1 | 5/1998 |
| WO | WO 98/24994 | | 6/1998 |
| WO | WO 98/24995 | | 6/1998 |
| WO | WO 98/38401 | A1 | 9/1998 |
| WO | WO 99/40273 | A1 | 8/1999 |
| WO | WO 99/66151 | | 12/1999 |
| WO | WO 99/66152 | | 12/1999 |
| WO | WO 00/06854 | | 1/2000 |
| WO | WO 00/20705 | A1 | 4/2000 |
| WO | WO 00/20706 | A1 | 4/2000 |
| WO | WO 00/66856 | A1 | 11/2000 |
| WO | WO 01/02103 | A2 | 1/2001 |
| WO | WO 01/02669 | A1 | 1/2001 |
| WO | 01/07729 | | 2/2001 |
| WO | 01/51733 | A1 | 7/2001 |
| WO | WO 01/66876 | A1 | 9/2001 |
| WO | WO 01/66877 | A1 | 9/2001 |
| WO | WO 01/75247 | A1 | 10/2001 |
| WO | WO 01/77461 | A1 | 10/2001 |
| WO | 01/96688 | | 12/2001 |
| WO | 01/98603 | | 12/2001 |
| WO | WO 01/98604 | A1 | 12/2001 |
| WO | 02/055809 | A1 | 7/2002 |
| WO | 02/055810 | A1 | 7/2002 |
| WO | 02/060691 | | 8/2002 |
| WO | WO 03/016654 | A1 | 2/2003 |
| WO | WO 03012224 | A1 | 2/2003 |
| WO | WO 03/025307 | A1 | 3/2003 |
| WO | 03/070384 | A1 | 8/2003 |
| WO | 03/078761 | | 9/2003 |
| WO | WO 03/074814 | A1 | 9/2003 |
| WO | WO 03/083234 | A1 | 10/2003 |
| WO | 03/099461 | A1 | 12/2003 |
| WO | WO 2004/053257 | A1 | 6/2004 |
| WO | WO 2004/083557 | A1 | 9/2004 |
| WO | WO 2005/054600 | A1 | 6/2005 |
| WO | WO 2005/068747 | A1 | 7/2005 |
| WO | 2005/077625 | A1 | 8/2005 |
| WO | 2005/110677 | A1 | 11/2005 |
| WO | 2006/008578 | A1 | 1/2006 |
| WO | WO 2006031169 | A1 | 3/2006 |
| WO | WO 2006/043893 | A1 | 4/2006 |
| WO | WO 2006088417 | A2 | 8/2006 |
| WO | 2006/111437 | A1 | 10/2006 |
| WO | 2006/113757 | A2 | 10/2006 |

OTHER PUBLICATIONS

Knight's American Mechanical Dictionary, Hurd and Houghton: New York (1876), p. 2051.

Opposition EP 0.698,162 B1—Facts-Grounds-Arguments, dated Apr. 1, 1999, pp. 1-56.

Opposition II EP 0.698,162 B1—Facts-Grounds-Arguments, dated Apr. 30, 1999, (17 pages)—with translation (11 pages).

Opposition I: Unilin Decor N.V./Välinge Aluminum AB, communication dated Jun. 8, 1999 to European Patent Office, pp. 1-2.

Opposition I: Unilin Decor N.V./Välinge Aluminum AB, communication dated Jun. 16, 1999 to European Patent Office, pp. 1-2.

FI Office Action dated Mar. 19, 1998.

NO Office Action dated Dec. 22, 1997.

NO Office Action dated Sep. 21, 1998.

Opposition EP 0.877.130 B1—Facts—Arguments, dated Jun. 28, 2000, pp. 1-13.

RU Application Examiner Letter dated Sep. 26, 1997.

NZ Application Examiner Letter dated Oct. 21, 1999.

European prosecution file history to grant, European Patent No. 94915725.9-2303/0698162, grant date Sep. 17, 1998.

European prosecution file history to grant, European Patent No. 98106535.2-2303/0855482, grant date Dec. 1, 1999.

European prosecution file history to grant, European Patent No. 98201555.4-2303/0877130, grant date Jan. 26, 2000.

Communication of Notices of Intervention by E.F.P. Floor Products dated Mar. 17, 2000 in European Patent Application 0698162, pp. 1-11 with annex pp. 1-21.

Response to the E.F.P. Floor Products intervention dated Jun. 28, 2000, pp. 1-5.

Letters from the Opponent dated Jul. 26, 2001 and Jul. 30, 2001 including Annexes 1 to 3.

Communication from European Patent Office dated Sep. 20, 2001 in European Patent No. 0698162, pp. 1-2 with Facts and Submissions Annex pp. 1-18, Minutes Annex pp. 1-11, and Annex I to VI.

Communication from Swedish Patent Office dated Sep. 21, 2001 in Swedish Patent No. 9801986-2, pp. 1-3 in Swedish with forwarding letter dated Sep. 24, 2001 in English.

Välinge, "Fibo-Trespo" Brochure, Distributed at the Domotex Fair in Hannover, Germany, Jan. 1996.

Träindustrins Handbook "Snickeriarbete", 2nd Edition, Malmö 1952, pp. 826, 827, 854, and 855, published by Teknografiska Aktiebolaget, Sweden.

"Träbearbetning", Anders Grönlund, 1986, ISBN 91-970513-2-2, pp. 357-360, published by Institutet for Trateknisk Forskning, Stockholm, Sweden.

Drawing Figure 25/6107 from Buetec Gmbh dated Dec. 16, 1985.

Pamphlet from Serexhe for Compact-Praxis, entitled "Selbst Teppichböden, PVC and Parkett verlegen", Published by Compact Verlag, München, Germany 1985, pp. 84-87.

Pamphlet from Junckers Industrser A/S entitled"Bøjlesystemet til Junckers boliggulve" Oct. 1994, , Published by Junckers Industrser A/S, Denmark.

Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, Vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.
Darko Pervan, U.S. Appl. No. 09/714,514 entitled "Locking System and Flooring Board" filed Nov. 17, 2000.
Darko Pervan et al., U.S. Appl. No. 10/508,198 entitled "Floorboards With Decorative Grooves" filed Sep. 20, 2004.
Darko Pervan, U.S. Appl. No. 10/509,885 entitled "Mechanical Locking System for Floorboards" filed Oct. 4, 2004.
Darko Pervan, U.S. Appl. No. 10/970,282 entitled "Mechanical Locking System for Floor Panels" filed Oct. 22, 2004.
Darko Pervan, U.S. Appl. No. 10/906,356 entitled "Building Panel With Compressed Edges and Method of Making Same" filed Feb. 15, 2005.
Darko Pervan, U.S. Appl. No. 11/092,748 entitled "Mechanical Locking System for Panels and Method of Installing Same" filed Mar. 30, 2005.
Darko Pervan, U.S. Appl. No. 10/908,658 entitled "Mechanical Locking System for Floor Panels" filed May 20, 2005.
Darko Pervan et al, U.S. Appl. No. 11/161,520 entitled "Method of Making a Floorboard and Mehtod of Making a Floor With the Floorboard" filed Aug. 6, 2005.
Jacobsson, Jan, et al., U.S. Appl. No. 11/521,439, entitled "Device and Method for Compressing an Edge of a Building Panel and a Building Panel With Compressed Edges", filed on Sep. 15, 2006.
Jacobsson, Jan, U.S. Appl. No. 11/635,631, entitled "Floor Light", filed Dec. 8, 2006.
Pervan, Darko, et al., U.S. Appl. No. 11/635,674, entitled "Laminate Floor Panels", filed Dec. 8, 2006.
Pervan, Darko, et al., U.S. Appl. No. 11/635,633, entitled "Laminate Floor Panels" filed Dec. 8, 2006.
Hakansson, Niclas, U.S. Appl. No. 11/643,881, entitled "V-Groove", filed Dec. 22, 2006.
Bergelin, Marcus, et al., U.S. Appl. No. 11/649,837, entitled "Resilient Groove", filed Jan. 5, 2007.
Pervan, Darko, et al., U.S. Appl. No. 11/575,600, entitled "Mechanical Locking of Floor Panels with a Flexible Tongue", filed Mar. 20, 2007.
Pervan, Darko, U.S. Appl. No. 11/806,478, entitled "Wear Resistant Surface", filed May 31, 2007.
Pervan, Darko, et al., U.S. Appl. No. 11/770,771, entitled "Locking System Comprising a Combination Lock for Panels", filed Jun. 29, 2007.
Pervan, Darko, et al., U.S. Appl. No. 11/775,885, entitled "Mechanical Locking of Floor Panels with a Flexible Bristle Tongue", filed Jul. 11, 2007.
International Search Report issued in corres. PCT/SE2005/001463 (Published as WO 2006/038867 A1), Feb. 16, 2006, Swedish Patent Office, Stockholm, SE.
International Preliminary Report on Patentability and accompanying Written Opinion issued in corres. PCT/SE2005/001463 (Published as WO 2006/038867 A1), Apr. 11, 2007, The International Bureau of WIPO, Geneva, CH.
Official Action issued in JP 2007-535639, Sep. 25, 2009, pp. 1-3, Japanese Patent Office, JP; and English translation thereof.
Office Action issued in the corresponding European Patent Application No. 05 789 595.5-2424 dated Jun. 9, 2010.
Office Action issued in the corresponding European Patent Application No. 05 789 595.5-2424 dated Jan. 12, 2010.
Pervan, Darko, et al., U.S. Appl. No. 13/045,631, entitled "Floorboards with Decorative Grooves," filed in the U. S. Patent and Trademark Office on Mar. 11, 2011.
Bergelin, Marcus, et al., U.S. Appl. No. 13/046,011, entitled "Resilient Groove," filed in the U. S. Patent and Trademark Office on Mar. 11, 2011.

* cited by examiner

APPLIANCE AND METHOD FOR SURFACE TREATMENT OF A BOARD SHAPED MATERIAL AND FLOORBOARD

CROSS-REFERENCE TO RELATED APPLICATIONS

The present application claims the benefit of U.S. provisional application Ser. No. 60/615,963, filed in the United States on Oct. 6, 2004. The present application also claims the priority of SE 0402419-6, which was filed in Sweden on Oct. 5, 2004. The contents of U.S. Ser. No. 60/615,963 and SE 0402419-6 are incorporated herein by reference.

TECHNICAL FIELD

The invention relates generally to the technical field of surface treatment of sheet-shaped blanks. The invention relates to a device and a method for providing such surface treatment. The invention also concerns a floorboard with a machined and finished edge. The invention is particularly suited for use in floorboards having mechanical locking systems. More specifically, the invention relates above all to floors of the type that has a core and a decorative top layer on the upper side of the core.

FIELD OF APPLICATION

The present invention is particularly suited for use in floating floors, which are made of floorboards, which on the one hand are joined mechanically with a joint system which is integrated with the floorboard, i.e. factory mounted, and on the other hand are made up of one or more preferably moisture-proof upper layers of decorative laminate, preferably comprising sheet material impregnated with thermosetting resins or other decorative plastic material, an intermediate core of wood fiber-based material or plastic material and preferably a lower balancing layer on the rear side of the core. The following description of prior-art techniques, problems of known systems as well as the objects and features of the invention will therefore as non-limiting examples be aimed mainly at this field of application, in particular, laminate floors as well as varnished, oiled or painted wooden floors. However, it should be emphasized that the invention can be used for any boards, e.g., floor, wall, ceilings and wall panels, and in any board materials and in floorboards with any joint systems and also floorboards which are not floating but which are glued or nailed to a subfloor. The invention can thus also be applicable to, for instance, floors with one or more layers of wood, plastic material, linoleum or combinations of different materials, such as wood, plastic, cork, rubber or other materials that are used as surface layers in floors. The invention can also be applied to make decorative surface portions in homogeneous materials, for instance homogeneous wooden floors, or to apply moisture-repellent layers, friction-changing layers, glue or the like to joint portions in sheet-shaped blanks.

BACKGROUND OF THE INVENTION

Laminate flooring usually consists of a core of a 6-9 mm fiberboard, a 0.2-0.8 mm thick upper decorative top layer of laminate, preferably comprising sheet material impregnated with thermosetting resins and a 0.1-0.6 mm thick lower balancing layer of laminate, plastic, paper or like material. The top layer provides appearance and durability to the floorboards. The core provides stability, and the balancing layer keeps the board plane when the relative humidity (RH) varies during the year. The floorboards are generally laid floating, i.e., without gluing, on an existing subfloor.

Traditional hard floorboards in floating flooring of this type are usually joined by means of glued tongue and groove joints.

In addition to such traditional floors, floorboards have recently been developed which do not require the use of glue and instead are joined mechanically by means of so-called mechanical joint systems. These systems comprise locking means, which lock the boards horizontally and/or vertically. The mechanical joint systems can be formed by machining of the core of the board. Alternatively, parts of the locking system can be formed of a separate material, which is integrated with the floorboard.

The main advantages of floating floors with mechanical joint systems are that they can easily and quickly be laid with great accuracy. A further advantage of the mechanical joint systems is that the edge portions of the floorboards can be made of materials, which need not have good gluing properties. The edge portions of the floorboard can therefore be impregnated with, for instance, wax, in order to improve the moisture properties.

The most common core material is fiberboard with high density and good stability, usually called HDF—High Density Fiberboard. Other wood fiberbased board materials, which could be used are, e.g., MDF (Medium Density Fiberboard), chipboard, plywood and OSB (Oriented Strand Board).

Laminate flooring and also many other floorings with a decorative top layer of plastic, linoleum, wood, veneer, cork and the like are made by the surface layer and the balancing layer being applied to a core material. This application may take place by gluing a previously manufactured decorative layer, for instance when the fiberboard is provided with a decorative high pressure laminate which is made in a separate operation where a plurality of sheets of paper, impregnated with thermosetting resins, are compressed under high pressure and at a high temperature. The currently most common method when making laminate flooring, however, is direct laminating which is based on a more modern principle where both manufacture of the decorative laminate layer and the fastening to the fiberboard take place in one and same manufacturing step. Sheets of paper, impregnated with thermosetting resins, are applied directly to the board and pressed together under pressure and heat without any gluing.

Thick top layers of wood, for instance 1-4 mm, are usually applied to a core consisting of wood blocks whose fiber direction is perpendicular to the fiber direction of the surface layer. Particle board, fiberboard or plywood is also used both when the top layer is thick and also when the top layers are thin veneer with a thickness of, for instance, 0.2-1.0 mm. The top layer of wood is usually protected with one or more layers of oil or varnish. In terms of manufacture it is advantageous if the surface treatment takes place before machining of the edge.

In addition to these methods, a number of other methods are used to provide the core with a surface layer. The core can be painted and varnished. A decorative pattern can be printed on the core surface, which is then, for instance, varnished with a wear layer.

As a rule, the above methods result in a floor element in the form of a large board, which is then sawn into, for instance, some ten floor panels, which are then machined along the edges to floorboards.

The machining of the edges is made in advanced milling machines where the floor panel is positioned between one or more chains and bands mounted in bearings, so that the floor panel can be moved at a high speed and with great accuracy past a number a milling motors, which are provided with diamond cutting tools or metal cutting tools, which machine the edge of the floor panel.

In all these manufacturing methods, the floor panel usually has a top layer when forming its edges by machining.

In recent years it has become more common to provide the above-mentioned floor types with bevels or decorative grooves preferably at the joint edges but also on the surface. These parts are made after providing the floorboard with the decorative top layer. After machining, the edge or decorative grooves must thus as a rule be coated in different manners with, for instance, varnish, paint or the like to achieve the necessary decorative properties and to protect the visible and exposed parts from moisture, dirt and wear. Parts of the joint system that are not visible from the surface are often also coated with property-improving agents, for instance wax, to improve the moisture-resistance and the laying function.

KNOWN TECHNIQUES AND PROBLEMS THEREOF

In manufacture of a laminate floor with, for instance, beveled edges or decorative grooves, which uncover the HDF core, the uncovered edge is protected with, for instance, paint or adhesive tape. Coating with paint usually occurs immediately after machining of the edge using spray nozzles. It is difficult to achieve efficient accuracy in relation to the surface of the top layer of the floorboard and in relation to corner portions. It is also difficult to achieve the required speeds. Existing equipments are complicated, expensive and require much maintenance. The paint covering the machined fibers is difficult to apply.

It is known that joint portions in wooden floors can be coated by means of wheels or rolls, which apply a varnish layer to an edge portion. The existing technique does not permit sufficiently high speeds and above all accuracy is not satisfactory. In many cases there will be undesirable residues of varnish on the surface of the decorative top layer. If this is to be avoided, there is a great risk that parts of the edge portions will not be coated.

SUMMARY AND OBJECTS

A first object is to provide a device and a method for coating a surface portion of sheet-shaped blanks, comprising a top layer, with liquid material, which eliminates or reduces one or more of the problems occurring in connection with the coating of machined portions, above all edge portions, with great accuracy.

A second object is to provide a floorboard with a decorative top layer of laminate, comprising sheet material impregnated with thermosetting resins, a core of a wood fiber based board, preferably HDF and a machined visible joint edge consisting of the core material. The machined edge, which thus consists of HDF fibers, is impregnated with a liquid material that is moisture-repellent, decorative and which besides is easier to apply with great accuracy to the machined edge than are the coating materials currently used.

The first object is achieved by the condition that the coating of, for instance, a machined surface portion, which touches an unmachined surface of a decorative top layer, should take place by means of a wheel which transfers a liquid material to the machined portion as well as to the unmachined surface of the top layer. The device has a compressed air system that blows away excessive rests of the liquid material from the surface of the unmachined top layer and towards the machined surface portion.

By selecting suitable chemicals that do not adhere to the unmachined surface of the top layer, especially if they are blown away preferably immediately after coating, exact application can occur where all machined surface portions closest to the unmachined surface of the top layer have obtained a coating while at the same time the unmachined surface of the top layer is free from the applied chemicals. Laminate floors and many other floors often have a surface, which is embossed to resemble a wood structure. In this context, compressed air is more efficient than other known methods, such as scraping off, to remove excess coating from the unmachined surface.

The invention is particularly suited for use in the joint edge portions of the floorboards, but one or more decorative recessed grooves according to the invention can also be arranged in any position between the joint edge portions of the floorboards.

The floorboard can thus have a surface that consists of a plurality of surface portions with decorative recessed grooves so that a surface pattern is formed with a pattern corresponding to tiles or elongate blocks or the like. Decorative surface portions can be placed in any position on the surface of the floorboard and they may have any extent or shape. They can be arranged on both neighboring edges of two joined floorboards, but they can also be arranged on one edge only. The decorative surface portion can, but need not, have an extent covering the entire joint edge. The decorative surface portion can be parallel to the joint edge but it can also have a deviating shape, such as wave-shaped. Moreover it does not need to have the same depth from the floor surface along its entire extent or between two neighboring joint edges. Coating of such variants can be effected by means of a wheel moving vertically and/or horizontally as the board is moved past the wheel. Decorative surface grooves in the surface of the board can be coated by means of one or more wheels cooperating with one or more compressed air nozzles that blow liquid excess material towards the inner parts of the grooves.

The invention is particularly suited for use in floorboards with mechanical joint systems which enable exact positioning of the decorative surface portions of the floorboards relative to each other and impregnation of joint edges to increase moisture resistance.

According to a first aspect, a device is provided for coating a surface portion of a sheet-shaped blank, comprising wood or wood fibers and an unmachined top layer, with a liquid coating material, said device comprising a wheel and a compressed air nozzle. The wheel transfers the coating material to the surface portion by a rotary motion, and the compressed air nozzle moves the coating material in a contactless manner using an air flow.

According to a second aspect, a method is provided for making a decorative edge on a floorboard, which has an unmachined top layer and a machined surface portion in the edge. The surface portion touches the unmachined surface of the top layer. The method is characterized in that the surface portion and a part of the unmachined surface of the top layer are coated with a liquid coating material, and that the coating material on the surface is then moved by air towards the machined surface portion.

The second object is achieved by a floorboard with a top layer preferably comprising sheet material impregnated with thermosetting resins a core of HDF and a machined edge of HDF which is impregnated with a pigmented oil.

The uncovered core is impregnated after machining. Such impregnation can take place with great accuracy if chemicals such as different types of pigmented oil or pigmented wax are used. Pigmented oil can be more suitable than wax since it does not have to be melted before application. A characteristic feature of these agents is that, in contrast to paint, they do not adhere to the laminate surface and, when blown away from the surface of the top layer and towards the machined surface portion with uncovered HDF fibers, they penetrate quickly into the core of the floorboard. Coating of a machined and beveled edge can take place quickly and easily with great accuracy. The invention allows essentially the entire laminate surface closest to the machined HDF edge to be free from coating material while at the same time essentially the entire HDF edge closest to the unmachined surface of the top layer is impregnated.

The machined joint edge of HDF, which is visible when the floorboards are joined can, of course, according to the invention be machined to a number of varying shapes, such as rounded, beveled in combination with different angles and radii. There may also be recessed grooves essentially parallel to the surface.

Examples of embodiments of the invention will now be described in more detail with reference to the accompanying drawings.

DESCRIPTION OF EMBODIMENTS OF THE INVENTION

Figure 1A:
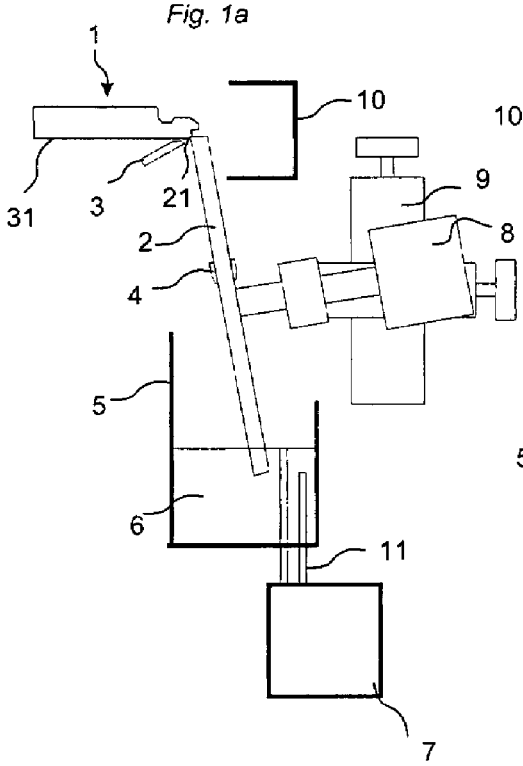
FIGS. 1*a-b* show a device for coating of board material.
Figure 1B:
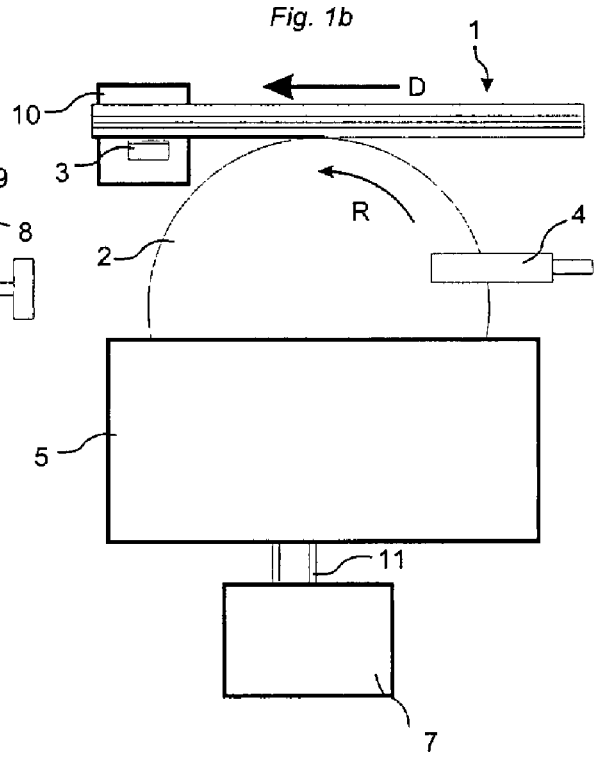

FIG. 1*a* shows a device according to an embodiment of the invention, for coating a surface portion of sheet-shaped blank 1, comprising a core 30 and a top layer 31, seen parallel to the direction of travel of the board and FIG. 1*b* shows the device seen perpendicular to the direction of travel of the board.

The sheet-shaped blank, for instance a floorboard 1 with a top layer, is driven preferably through a machining line horizontally in a direction D. In this embodiment, the floorboard 1 is oriented with an unmachined surface of the top layer 31 downwards. A machined surface portion 21, with the top layer removed touches a wheel 2, which rotates in the direction of travel R of the floorboard by means of a driving device 8. The wheel 2 is rotated at the same peripheral speed as the speed of feeding of the floorboard 1. The driving device 8 can rotate the wheel 2 at different speeds, preferably between 10 and 200 m/min. A suitable speed in connection with manufacture of floors is about 60-130 m/min. Using suitable chemicals, wheel diameters and materials selected for the wheel 2, high speeds of up to 200 m/min can be achieved without the coating material leaving the wheel. A suitable wheel diameter is 120-200 mm. The wheel can be provided with a freewheel so that any difference in speed between the board 1 and the wheel 2 can be leveled out. The width of the wheel portion W, which transfers the coating to the sheet-shaped blank, is preferably smaller than the width of the sheet-shaped blank and preferably in the range of 0.1-20 mm.

The wheel 2 is coated with a liquid material 6, such as pigmented oil, varnish, paint, wax, glue and the like, in a container 6 which preferably has a splash guard. The container can be provided with an inlet, a discharge and an overflow tube 11 for returning purposes.

In order to obtain the correct amount of coating material 6 on the wheel 2 there is preferably a scraper, which can be controlled and locked by a micrometer. It should be possible to adjust the wheel 2 with great accuracy relative to the board at an angle as well as vertically and horizontally. This is suitably performed by means of a turnable coordinate table 9. In FIG. 1*a* the wheel has an angle of about 10 degrees to the vertical plane. Suitable angles for coating of beveled edges are 0-45 degrees. A pump 7 can be used to continuously circulate the liquid coating material 6 via a filter.

A photocell, a mechanical device or the like can be arranged to activate a compressed air system with a nozzle 3 which blows excessive coating material away from the unmachined surface of the top layer 31 by an air flow A. Excessive material blown away by compressed air can be caught in a container 10 provided with a filter. The equipment can be provided with a PLC (Programmable Control System) controlled automatic cleaning system. The device allows coating with narrow tolerances. For instance, coating can be performed with an accuracy of about 0.1 mm in relation to the unmachined surface of the top layer. Optimum results are achieved preferably if the floorboard is correctly positioned relative to the wheel. This positioning can take place in the machining unit by means of, for instance, chains and bands, or when the floorboard leaves the machining unit by means of rules and pressing rollers. To achieve great accuracy it is also preferable for the wheel 2 to have essentially the same peripheral speed as the floorboard. It is advantageous if the difference in speed is less than 10 m/min. For a good result, it is not necessary for the wheel 2 to touch the floorboard. The coating material is transferred to the floorboard by surface tension.

Figure 2A:
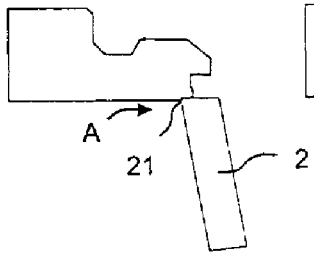
FIGS. 2*a-c* show examples of coating of different surface portions in a floor with a mechanical locking system.
Figure 2B:
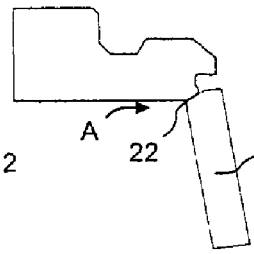
Figure 2C:
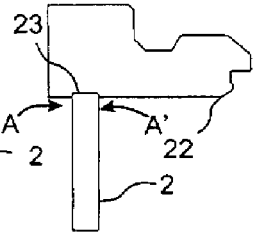

FIG. 2*a* illustrates coating of a decorative groove 21 which is substantially parallel to the surface of the top layer 31. In this embodiment an air flows A is used to blow away excessive coating material 6 from the surface of the top layer. FIG. 2*b* illustrates a beveled edge 22. FIG. 2*c* illustrates coating of a groove 23 which is located at a distance from the joint edge. In this embodiment, two air flows A, A' can be used to blow away excessive coating material 6 from the surface and towards the groove.

Figure 3A:
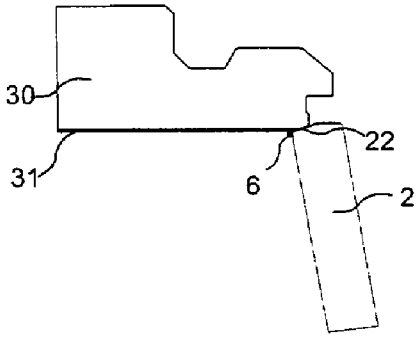
FIGS. 3*a-b* show examples of coating with excess paint which is sprayed away from the surface.
Figure 3B:
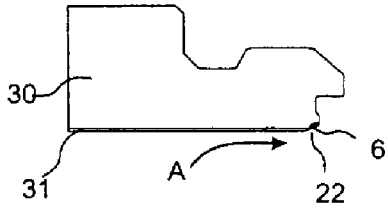

FIGS. 3*a* and 3*b* illustrate how a beveled edge 22, without the top layer, can be coated with liquid coating material, such as varnish or pigmented oil. In this embodiment, the floorboard 1 has an unmachined surface of a top layer 31 of, e.g., a laminate made of sheet material impregnated with thermosetting resins or varnished wood. The beveled edge is coated with coating material 6 which partly settles on the unmachined surface of the top layer 31. Excessive coating material is blown away by compressed air A which in this embodiment is blown parallel to the surface of the board and moves the excess material towards the beveled edge 22. FIG. 3*b* illustrates how the coating material 6 penetrates into the core 30 while at the same time the unmachined surface of the top layer 31 is free from coating material. Particularly good penetration can be achieved if the core consists of wood fiber-based materials, such as HDF, and if pigmented oils with a suitable viscosity are used, which is adapted to the absorbing capacity of the HDF material.

Figure 5A:
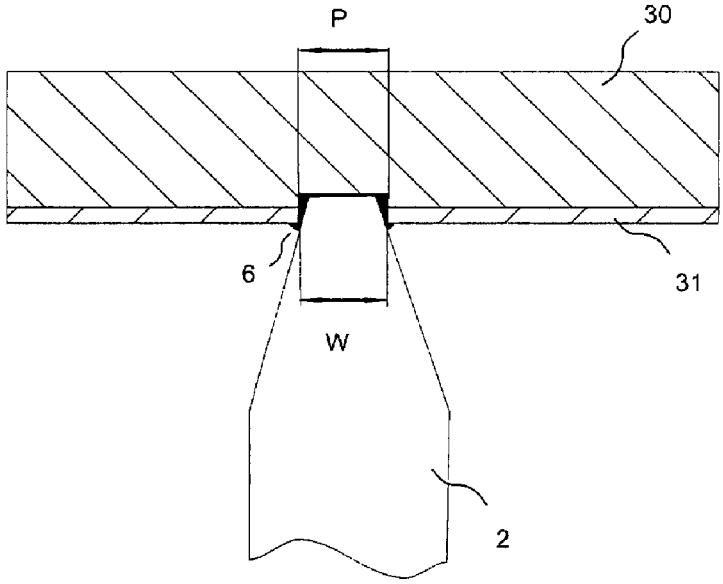
FIGS. 5*a-b* show the embodiments according to FIGS. 2*a* and 2*c* enlarged
Figure 5B:
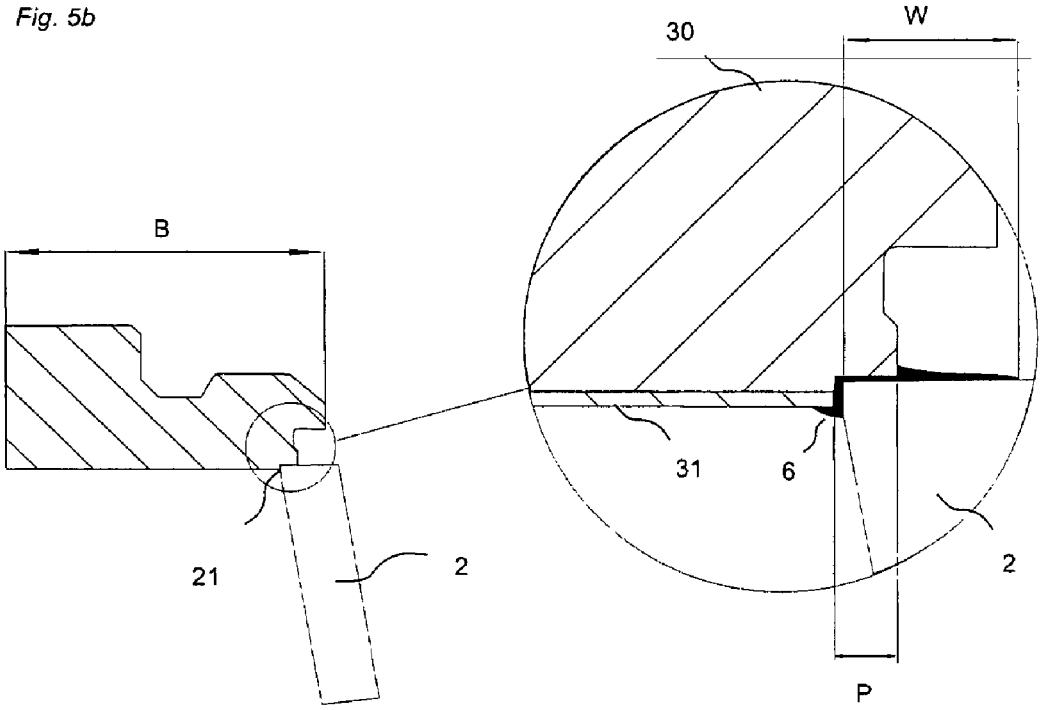

FIGS. 5*a* and 5*b* illustrate an enlargement of the coating according to the embodiments in FIGS. 2*a* and 2*c*. The machined surface portions are coated with coating material 6 which partly settles on the unmachined surface of the top layer 31. The excessive coating material on the surface of the top layer is removed by an airflow. In the embodiment in FIG. 5*a* a grove in the sheet-shaped blank is coated. The width of the wheel portion W, which transfers coating material to the groove, is essentially equal to the width of the groove P or slightly smaller. In the embodiment in FIG. 5*b* an edge groove of the sheet-shaped blank is coated. The width of the wheel W, which transfers coating material to the edge groove, is preferably larger than the width of the edge groove P.

If the edge of the wheel 2 has a suitable design and if the amount of coating material 6 is well adjusted while at the same time the amount, pressure and direction of the air are controlled in a convenient manner, coating of the machined edge can be performed with a better result than in using prior-art technique.

Figure 4A:
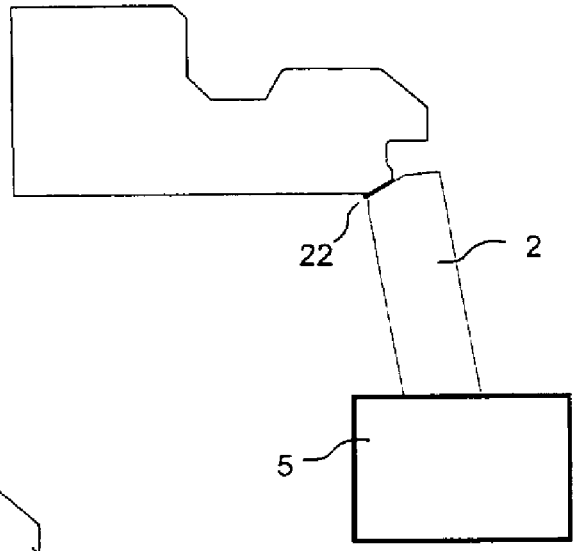
FIGS. 4*a-c* show coating by means of a plurality of wheels.
Figure 4B:
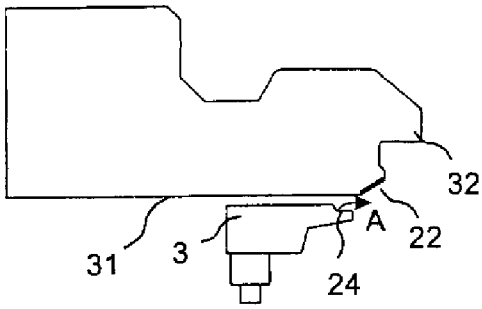
Figure 4C:
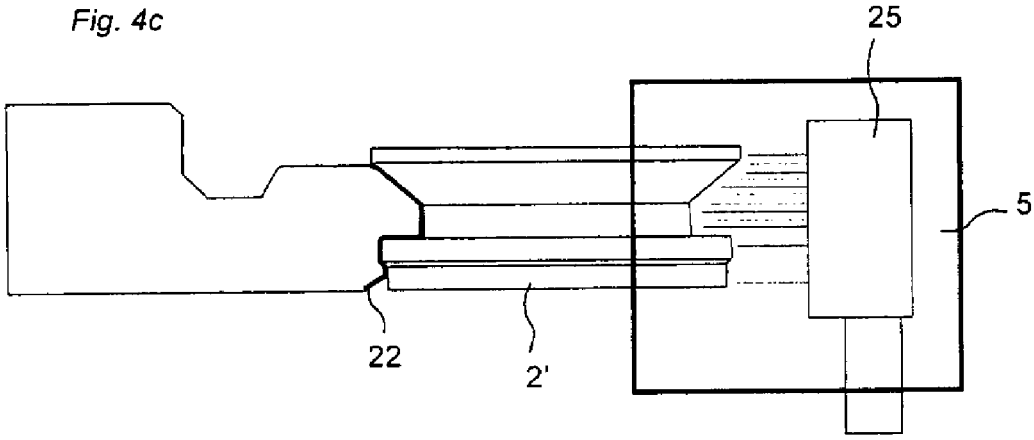

FIGS. 4*a-c* illustrate how a beveled edge 22, without the top layer and parts of the mechanical joint system, in this case the tongue portion 32, can be coated, for instance, with a decorative material on the beveled edge 22 and with an impregnating moisture-repellent material on the tongue 32.

In this embodiment coating is performed using two wheels 2, 2'. The nozzle 3 has an outlet 24 directing the air substantially parallel to the unmachined surface of the top layer 31 towards the edge portion 22.

In this embodiment the second wheel 2' operates substantially horizontally. The wheel can be coated with suitable liquid substances in different ways using, for example, a spray nozzle 25, with felt or suitable fiber materials containing the coating material and the like. Alternatively the wheel 2' can rotate in an associated vessel where the edges of the wheel establish a seal against the edges of the vessel. A plurality of wheels can be used. Various chemicals can be dried, hardened and the like after coating according to prior art, using ultrasound, UV light, heat etc.

The edge of the wheels 2 can be designed in various ways and they can operate at optional angles from above and from below. All parts of a mechanical joint system that can be machined by means of large rotating tools can also be coated by means of wheels, preferably, but not necessarily, in combination with compressed air which facilitates positioning of the coating material.

Wheels are preferably made of metal but they can also wholly or partly be made of plastic or rubber material. They can be heated and they can contain ducts directing the coating material to different contact surfaces between wheel and board. A plurality of different coating materials can be applied in different steps in succession. The wheels can also be used to shape, by pressure, parts of the joint edge by compression of fibers. Vacuum can be applied to the board in order to facilitate penetration. Liquid materials can be applied which after hardening become elastic and which then may constitute a joint seal that prevents moisture from penetrating through the joint system. In this case the edges do not have to be beveled.

The chemical composition of the coating material is important for a good result. A suitable chemical for coating of wood fiber-based board materials such as HDF, MDF, particle board, plywood and the like is pigmented oil. Such a chemical quickly penetrates into wood fiber-based materials, prevents penetration of moisture into the machined surface portion while at the same time different pigments make it possible to provide decorative edge portions or grooves which may have the same shades of color as the surface of the top layer, or shades deviating therefrom. Suitable pigments are organic pigments which are used, inter alia, in the graphical industry for printing on paper. These pigments function well together with wood-based board materials. Vegetable alkyds can be used as binder for the pigments. Mineral oil can be used to reduce the viscosity so that the coating material quickly and easily can penetrate into the wood fiber-based core while at the same time it adheres to the wheel and does not leave the wheel at high peripheral speeds. A suitable composition measured in parts by weight is about 10-15% organic pigments, about 30-35% vegetable alkyds and 50-55% mineral oil. These parts by weight can also be 5 percentage units greater or smaller than the range stated. Of course, also other mixtures can be used within the scope of an important basic principle that the coating material should contain pigments, a binder and a viscosity-reducing agent. Another important basic principle is that the mixing ratios should be such that the greatest share is a viscosity-reducing agent while the lowest share is pigments.

Further chemical substances can be added, such as other types of oils, hardeners and like agents. These agents can also be combined with additives that can improve the durability, such as alumina. It goes without saying that these additives may affect the above mixing ratios.

Pigmented oil is highly convenient for use in floorboards with a surface layer of laminate. The oil does not penetrate into the laminate surface and easily slides off the laminate surface without leaving any visible traces when exposed to a suitable air flow which directs the oil towards the machined joint edge where it is easily and quickly absorbed by the HDF fibers.

The chemical composition described above also constitutes an invention which can be used independently as a coating material, for instance together with the prior-art methods of, for instance, coating a surface in a joint edge preferably of a floorboard with a wood fiber-based core or surface layer.

There may be a number of variants. The device can be used for coating of previously treated surfaces and for changing the surface properties in terms of appearance and function. Compressed air can be used to position and move liquid coating material also in the cases when coating is performed in some other manner than by means of wheels, for instance by means of coating tools that coat machined surfaces.

What is claimed is:

1. A device for coating a liquid coating material on a surface portion of a machine fed sheet-shaped blank comprising a core of wood or wood fibers and a top layer, wherein the surface portion is distinct from the top layer such that at least a portion of the surface portion is displaced from the plane of the top layer, said device comprising:

an angled wheel rotatably disposed relative to a container of liquid coating material, said angled wheel positioned for receiving a machine fed sheet-shaped blank such that rotary motion of said angled wheel is adapted to transfer coating material to the surface portion and to at least a part of a surface of the top layer of the sheet-shaped blank, and a compressed air nozzle disposed proximal the top layer of the sheet-shaped blank, said compressed air nozzle directing an excess of the coating material applied to the surface of the top layer of the sheet-shaped blank toward the surface portion of the sheet-shaped blank, wherein, when in use, the angled wheel transfers the excess of the coating material to the surface portion and to at least part of the surface of the top layer by rotary motion, and the compressed air nozzle applies air to the surface of the top layer so as to move at least the excess coating material applied to the surface of the top layer in a contactless manner using an air flow, and wherein the wheel has a rotational plane and, when in use, the air nozzle applies air in a direction substantially parallel to the top layer and towards the rotational plane of the wheel.

2. The device as claimed in claim 1, wherein the surface portion is an edge of the sheet-shaped blank, and a width of a portion of the wheel transferring the coating material, is broader than a width of the surface portion.

3. The device as claimed in claim 1, wherein the surface portion is a groove in the sheet-shaped blank, and a width of a portion of the wheel transferring the coating material is essentially equal or slightly smaller than a width of the surface portion.

4. The device as claimed in claim 1, wherein the sheet-shaped material is a floorboard with a mechanical locking system.

5. The device as claimed in claim 1, wherein the surface portion touches a portion of the top layer and is visible from a surface of the top layer when the sheet shaped blank is mounted.

6. The device as claimed in claim 5, wherein the air from the compressed air nozzle moves the coating material from the surface of the top layer to the surface portion.

7. The device as claimed in claim 2, wherein the top layer is a laminate, and the core material is HDF.

8. The device as claimed in claim 2, wherein the top layer material is plastic, linoleum or rubber, and the core material is HDF.

9. The device as claimed in claim 2, wherein the top layer material is wood or wood veneer protected with one or more layers of oil or varnish, and the core material is wood or wood fiber.

10. The device as claimed in claim 2, wherein the core material is massive wood and the top layer is a protecting layer of oil or varnish.

11. The device as claimed in claim 1, wherein the coating material is a pigmented oil.

12. The device as claimed in claim 1, wherein the wheel has a scraper which controls an amount of coating material on outer parts of the wheel as the wheel rotates.

13. The device as claimed in claim 11, wherein the coating material comprises pigments, a binder and a viscosity-reducing agent.

14. The device as claimed in claim 11, wherein the coating material comprises organic pigments, vegetable alkyds and mineral oil.

15. The device as claimed in claim 14, wherein a largest percentage share by weight of the coating material is mineral oil and a lowest share is pigments.

16. The device as claimed in claim 1, further comprising a filter container for receiving excess of coating material which is blown away by the air flow.

17. The device as claimed in claim 1, wherein a width of the wheel is always smaller than a width of the sheet-shaped blank.

18. The device as claimed in claim 7, wherein the top layer is a sheet material impregnated with thermosetting resins.

19. The device as claimed in claim 1, wherein a width of a portion of the wheel for applying the coating material to the sheet-shaped blank is 0.1 to 20 mm.

20. The device as claimed in claim 1, wherein the wheel is arranged at an angle with respect to a vertical plane of the sheet-shaped blank.

21. The device as claimed in claim 1, wherein the air nozzle is arranged to apply air in a transverse direction with respect to a direction of advancement of the sheet-shaped blank.

22. The device as claimed in claim 1, further comprising at least one device for detecting an application of an excessive amount of coating material, and for activating the air nozzle.

23. The device as claimed in claim 1, wherein the wheel is adjustable relative to the sheet-shaped blank at an angle, vertically and horizontally.

24. The device as claimed in claim 1, wherein the device has a machine direction, the wheel has a downstream, in the machine direction, outer edge, the outer edge having a portion at the downstream most point of the wheel with respect to a line drawn from the plane of blank, wherein the compressed air nozzle is arranged substantially in line with the portion of the outer edge that is the downstream most point of the wheel.

25. The device as claimed in claim 1, wherein the coating material moved by the air flow is collected in a filter container.

26. The device as claimed in claim 1, wherein the coating material is contained in a first and second container, wherein the coating material is circulating between the first and second container to obtain the correct amount of coating material in the first container supplied to the wheel.

27. The device as claimed in claim 1, wherein the surface portion comprises a beveled edge and said compressed air nozzle directs an excess of the coating material applied to the surface of the top layer of the sheet-shaped blank toward the beveled edge of the sheet-shaped blank.

28. The device as claimed in claim 1, wherein the surface portion comprises a groove and said compressed air nozzle directs an excess of the coating material applied to the surface of the top layer of the sheet-shaped blank toward the groove of the sheet-shaped blank.

29. A device for coating a liquid coating material on a surface portion of a floorboard comprising a core of wood or wood fibers and a top layer, wherein the surface portion is distinct from the top layer such that at least a portion of the surface portion is displaced from the plane of the top layer, said device comprising:

an angled wheel rotatably disposed relative to a container of liquid coating material, said angled wheel positioned for receiving a machine fed sheet-shaped blank such that rotary motion of said angled wheel is adapted to transfer coating material to the surface portion and to at least a part of a surface of the top layer of the sheet-shaped blank;

a compressed air nozzle disposed proximal the top layer of the sheet-shaped blank, said compressed air nozzle directing an excess of the coating material applied to the surface of the top layer of the sheet-shaped blank toward the surface portion of the sheet-shaped blank; and a filter container for receiving the excess of coating material which is blown away by air flow from the compressed air nozzle, wherein the wheel is arranged so as to transfer the excess of the coating material to the surface portion and to at least part of a surface of the top layer by a rotary motion, and the compressed air nozzle is arranged to apply air to the top layer so as to move the excess coating material in a contactless manner using an air flow, the air flow arranged to move the coating material from the surface of the top layer to the surface portion, and wherein the wheel has a rotational plane and the air nozzle is arranged to apply air in a direction substantially parallel to the top layer and towards the rotational plane of the wheel.

* * * * *